US008517510B2

(12) United States Patent
Ring et al.

(10) Patent No.: US 8,517,510 B2
(45) Date of Patent: Aug. 27, 2013

(54) FLUID DISPENSING APPARATUS AND METHOD THEREOF

(75) Inventors: James W. Ring, Blodgett, OR (US); Ralph Stathem, Lebanon, OR (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 35 days.

(21) Appl. No.: 13/259,652

(22) PCT Filed: Jul. 24, 2009

(86) PCT No.: PCT/US2009/051616

§ 371 (c)(1), (2), (4) Date: Sep. 23, 2011

(87) PCT Pub. No.: WO2011/011012

PCT Pub. Date: Jan. 27, 2011

(65) Prior Publication Data

US 2012/0081462 A1 Apr. 5, 2012

(51) Int. Cl.
*B41J 2/135* (2006.01)

(52) U.S. Cl.
USPC ..... 347/44

(58) Field of Classification Search
USPC ..... 347/44
See application file for complete search history.

(56) References Cited

U.S. PATENT DOCUMENTS 5,055,856 A * 10/1991 Tomii et al. ..... 347/30
5,818,485 A * 10/1998 Rezanka ..... 347/89
5,852,459 A * 12/1998 Pawlowski et al. ..... 347/86
7,407,241 B2 * 8/2008 Mutoh et al. ..... 347/5
2006/0044369 A1 3/2006 Mutoh et al.
2008/0192075 A1 8/2008 Campion et al.
2008/0218566 A1 * 9/2008 Malik et al. ..... 347/86
2009/0122093 A1 * 5/2009 Mutoh ..... 347/7

FOREIGN PATENT DOCUMENTS

JP 05-201028 A 8/1993
JP 2004-098611 A 4/2004

OTHER PUBLICATIONS

International Search Report and Written Opinion received in PCT Application No. PCT/US2009/051616, mailed Jan. 28, 2010, pp. 10.

* cited by examiner

*Primary Examiner* — Matthew Luu
*Assistant Examiner* — Michael Konczal

(57) ABSTRACT

A fluid dispensing apparatus including a fluid ejector including a fluid reservoir having fluid, and configured to eject the fluid, a vacuum pump configured to create negative pressure in an activation mode and to create approximately no pressure in a deactivation mode, a meniscus pressure regulator configured to regulate the negative pressure received from the vacuum pump, a leaking member configured to reduce the negative pressure received from the vacuum pump towards or equal to atmospheric pressure in response to the vacuum pump being placed in the deactivation mode, and a back pressure regulator having a pressure reference port to receive the reduced negative pressure from the leaking member and the regulated negative pressure from the meniscus pressure regulator, the back pressure regulator configured to maintain a non-retraction negative pressure value to position a fluid meniscus in a non-retracted state and a retraction negative pressure value to position the fluid meniscus in a retracted state.

19 Claims, 4 Drawing Sheets

FLUID DISPENSING APPARATUS AND METHOD THEREOF

BACKGROUND

Fluid dispensing technology such as inkjet printing technology is widely used in many commercial products such as printers, facsimile machines, and multifunctional devices including a printing function. Typical inkjet printers include an inkjet print head that receives ink from an ink reservoir. An ink channel supplies ink from the ink reservoir to the inkjet print head. The inkjet print head includes ejection chambers with corresponding nozzles. An ejection member creates pressure on the ink within the ejection chamber to eject ink through a corresponding nozzle, for example, in a form of ink drops. After ejecting the ink from the ejection chamber, new ink is drawn into the ejection chamber from the ink channel.

BRIEF DESCRIPTION OF THE DRAWINGS

Exemplary non-limiting embodiments of the general inventive concept are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Described herein are example apparatuses and methods associated with retracting a fluid meniscus in a cost-effective manner in a fluid dispensing apparatus. When a fluid ejector is idle, the fluid at the nozzles can form a fluid meniscus and be in contact with ambient air for an extended period of time. Consequently fluid such as ink contacting the air tends to become crusty or harden over time. Accordingly, a nozzle may become completely clogged if the fluid on the nozzle is exposed to air too long without any fluid being ejected. Conventional fluid dispensing apparatuses use costly capping systems to control nozzle health. In one embodiment of the present general inventive concept, a vacuum pump in combination with a meniscus pressure regulator is configured to cause the fluid meniscus to be in a retracted state, that is, retracted away from the respective nozzle and/or ejection chamber of a fluid ejector into a fluid channel to minimize exposure to air in a cost-effective manner. Accordingly, the fluid does not remain in the nozzles and reduces a possibility of the fluid drying or crusting in the nozzles. Further, in thermal inkjet printing apparatuses, kogation can also be removed by selectively retracting the fluid away from the heater and dry firing the heater.

Figure 1:
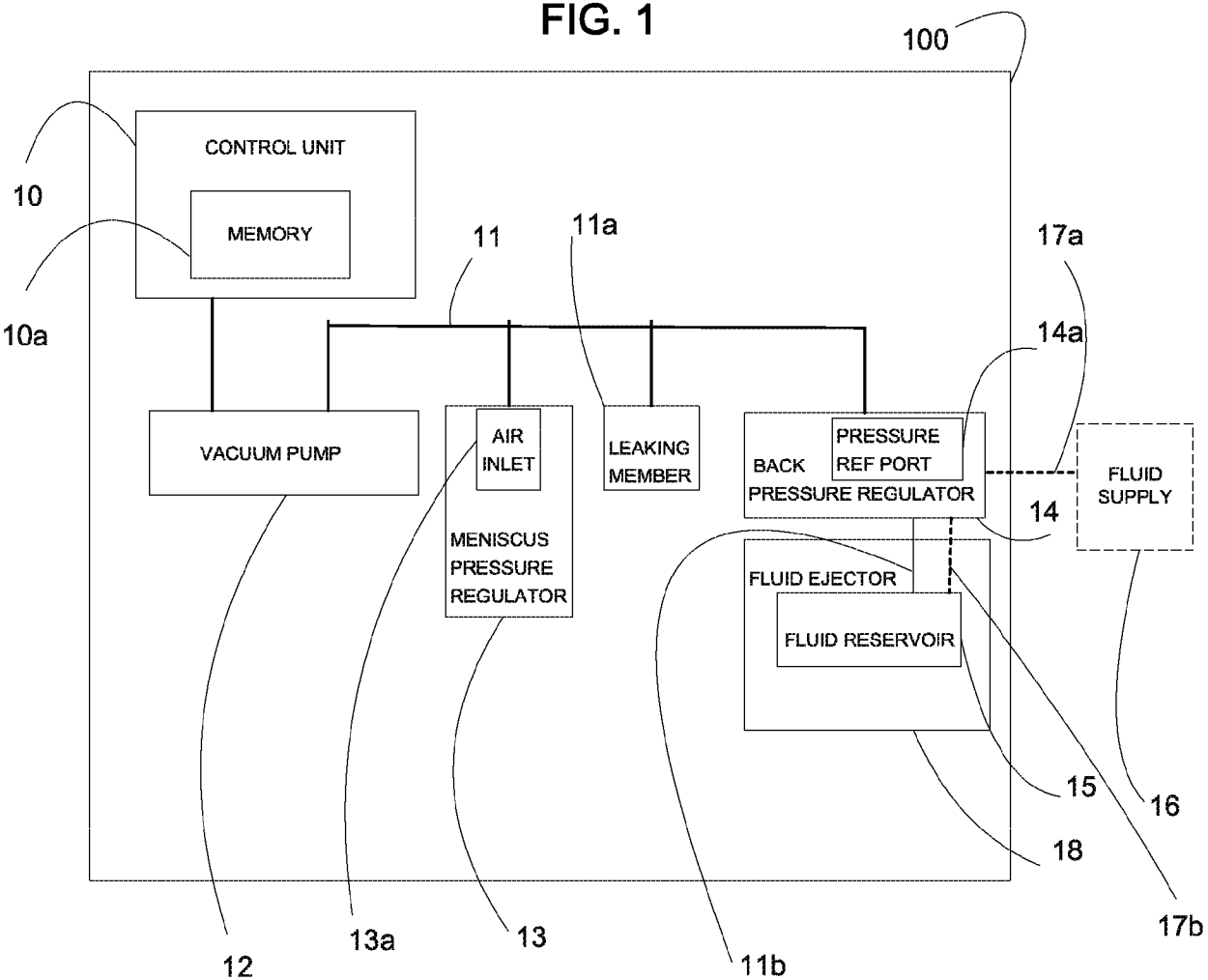
FIG. 1 is a block diagram illustrating a fluid dispensing apparatus according to an embodiment of the present general inventive concept.

FIG. 1 is a block diagram illustrating a fluid dispensing apparatus according to an embodiment of the present general inventive concept. In the present embodiment, a fluid dispensing apparatus 100 includes a fluid ejector 18 including a fluid reservoir 15 configured to contain fluid, a vacuum pump 12 configured to create negative pressure in an activation mode and to create approximately no pressure in a deactivation mode, a meniscus pressure regulator 13 configured to regulate the negative pressure received from the vacuum pump 12, a leaking member 11*a* configured to reduce the negative pressure received from the vacuum pump 12 towards or equal to atmospheric pressure in response to the vacuum pump 12 being placed in the deactivation mode, and a back pressure regulator 14 having a pressure reference port 14*a* to receive the reduced negative pressure from the leaking member 11*a* and the regulated negative pressure from the meniscus pressure regulator 13.

Figure 2:
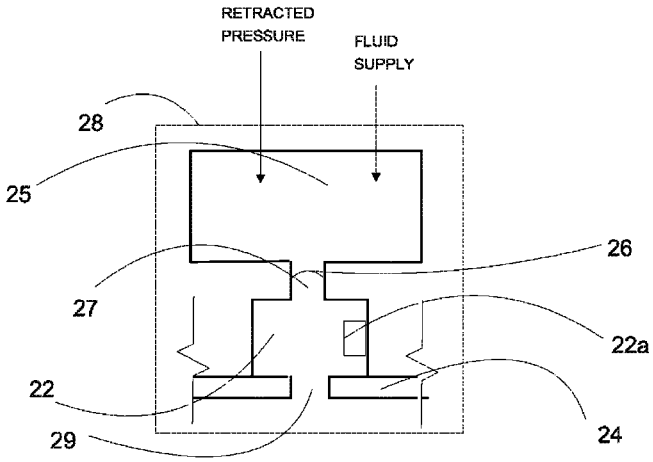
FIG. 2 is a partial cross-sectional view of a fluid ejector with a fluid meniscus in a retracted state of a fluid dispensing apparatus according to an embodiment of the present general inventive concept.

In the present embodiment, the back pressure regulator 14 is configured to maintain a non-retraction negative pressure value to position a fluid meniscus 26 in a non-retracted state (FIG. 3) and a retraction negative pressure value to position the fluid meniscus 26 in a retracted state (FIG. 2). The meniscus pressure regulator 13 has an air inlet 13*a* to allow air to flow therethrough when the meniscus pressure regulator 13 is activated. The meniscus pressure regulator 13 is activated, for example, when a pressure value is equal to or exceeds its respective regulator set point. The fluid ejector 18 is configured to eject the fluid. In the present embodiment, the fluid may be ink, the ejected fluid may be ink drops, and the fluid dispensing apparatus 100 may be an inkjet printing apparatus.

In one embodiment, the fluid dispensing apparatus 100 may also include a control unit 10 having a memory 10*a*, a main pressure communication path 11 between each of the vacuum pump 12, the meniscus pressure regulator 13, the leaking member 11*a* and the pressure reference port 14*a* of the back pressure regulator 14. The fluid dispensing apparatus 100 may also include a secondary pressure communication path 11*b* between the back pressure regulator 14 and the fluid reservoir 15 of the fluid ejector 18. The main pressure communication path 11 and the secondary pressure communication path 11*b* allow pressure to influence a position of the fluid meniscus 26 in the non-retracted state (FIG. 3) and the retracted state (FIG. 2). In one embodiment, the main pressure communication path 11 and the secondary pressure communication path 11*b* may be a conduit, hose, tube, channel or the like.

Referring to FIG. 1, in one embodiment, the fluid dispensing apparatus 100 may also include a fluid supply 16 configured to supply the fluid to the fluid reservoir 15 of the fluid ejector 18. In one embodiment, the fluid may be supplied through the back pressure regulator 14 through a main fluid communication path 17*a* between the fluid supply 16 and the back pressure regulator 14, and a secondary fluid communication path 17*b* between the back pressure regulator 14 and the fluid reservoir 15 of the fluid ejector 18. In other embodiments, the fluid supply 16 may supply the fluid directly to the fluid reservoir 15 of the fluid ejector 18. In yet other embodiments, referring to FIGS. 4 and 5, a fluid ejector 48 (FIGS. 4 and 5) may be a removable print head, for example, a removable inkjet print head, and a fluid reservoir 25 of the fluid ejector 48 may also serve as a fluid supply.

In the present embodiment, the non-retraction negative pressure value is a predetermined pressure value produced by the back pressure regulator 14 added to the reduced negative pressure received at the pressure reference port 14*a* from the leaking member 11*a*. The retraction negative pressure value, for example, is the predetermined pressure value added to the regulated negative pressure received at the pressure reference port 14*a* from the meniscus pressure regulator 13. In one embodiment, the predetermined pressure value produced by the back pressure regulator 14 is approximately −6 inches of water pressure. The regulated negative pressure from the meniscus pressure regulator 13 is in a range of, but not limited to, approximately −24 inches of water pressure to −37 inches of water pressure. In this embodiment, the predetermined regulator set point for the meniscus pressure regulator 13 is in a range of, but not limited to, −24 inches of water pressure to −37 inches of water pressure. As the retraction negative pressure value, for example, is a sum of the regulated negative pressure received at the pressure reference port 14*a* and the predetermined pressure value produced by the back pressure regulator 14, in the present embodiment, the retraction negative pressure value is in a range from −30 inches of water pressure to −43 inches of water pressure.

In one embodiment, the reduced negative pressure is in a range of, but not limited to, approximately atmospheric pressure to −9 inches of water pressure. As the non-retraction pressure value, for example, is a sum of the reduced negative pressure received at the pressure reference port 14*a* produced by the leaking member 11*a* and the predetermined pressure value produced by the back pressure regulator 14, in the present embodiment, the non-retraction negative pressure value is in a range of, but not limited to, approximately −6 inches of water pressure to −15 inches of water pressure.

Figure 3:
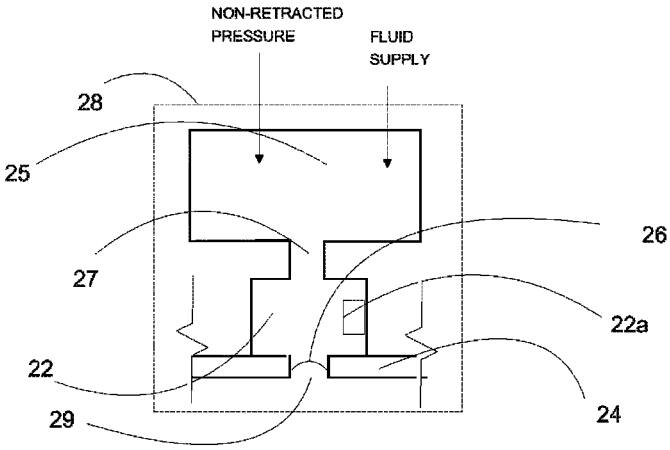
FIG. 3 is a partial cross-sectional view illustrating the fluid ejector of FIG. 2 with the fluid meniscus in a non-retracted state of a fluid dispensing apparatus according to an embodiment of the present general inventive concept.

FIGS. 2 and 3 are partial cross-sectional views of a fluid ejector with a fluid meniscus of a fluid dispensing apparatus. In particular, FIG. 2 illustrates a fluid ejector 28 with the fluid meniscus 26 in a retracted state. FIG. 3 illustrates a fluid ejector 28 with the fluid meniscus 26 in a non-retracted state. Referring to FIGS. 2 and 3, in the present embodiment, a fluid ejector 28 includes a nozzle 29, an ejection chamber 22 having an ejection member 22*a* configured to apply an ejection pressure to the fluid to eject the fluid through the nozzle 29, a fluid channel 27, and a fluid reservoir 25 configured to supply the fluid to the ejection chamber 22 through the fluid channel 27 disposed between the fluid reservoir 25 and the ejection chamber 22. In one embodiment, the non-retracted state includes the fluid meniscus 26 disposed in at least one of the nozzle 29 and the ejection chamber 22 downstream of the fluid channel 27 in response to a non-retracted pressure provided in the fluid reservoir 25 of the fluid ejector 28. The retracted state, for example, includes the fluid meniscus 26 disposed in the fluid channel 27 disposed upstream from the ejection chamber 22 in response to a retracted pressure provided in the fluid reservoir 25 of the fluid ejector 28. The nozzle 29, for example, may be formed through a fluid ejector housing 24.

The fluid channel 27 illustrated in FIGS. 2-5 is depicted as being connected to a single ejection chamber 22 and a single nozzle 29. However, in other embodiments, the fluid ejector 28 and 48 would include a plurality of ejection chambers with corresponding nozzles. The fluid channel 27 may be connected to an array of ejection chambers. In some embodiments, the fluid channel 27 may fan out or split out into many smaller sub-channels associated with each ejection chamber or a small group of ejection chambers. Each ejection chamber, for example, may be supplied with the fluid by a corresponding sub-channel.

In the present embodiment, the fluid dispensing apparatus 100 is an inkjet printing apparatus. In other embodiments, the fluid dispensing apparatus 100 may include other types of dispensing devices that dispense fluids other than ink. In a thermal inkjet printing apparatus, the fluid reservoir 100 supplies the fluid channel 27 with ink. The ink will flow along the fluid channel 27 to the ejection chamber 22. During a printing process, the ejection chamber 22 will eject ink through the corresponding nozzle 29. The ink may be ejected by the ejection member 22*a*, e.g., a heater, heating the ink within the ejection chamber 22. When the ink has been heated to an appropriate temperature and expanded, an ink drop is ejected through the nozzle 29. Alternatively, in a piezoelectric inkjet printing apparatus, a voltage is applied to the ejection member, e.g., a piezoelectric material disposed in the ejection chamber 22, to expand and cause ink to be ejected from the ejection chamber 22.

Figure 4:
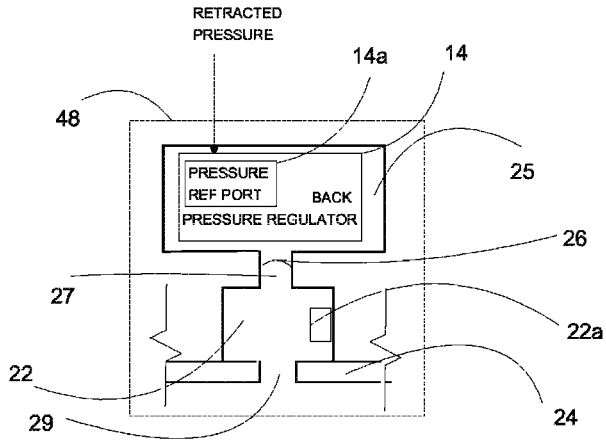
FIG. 4 is a partial cross-sectional view of another fluid ejector with a fluid meniscus in a retracted state of a fluid dispensing apparatus according to an embodiment of the present general inventive concept.
Figure 5:
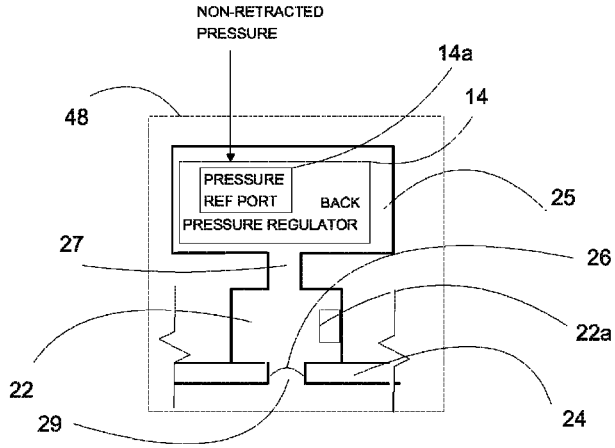
FIG. 5 is a partial cross-sectional view illustrating the fluid ejector of FIG. 4 with the fluid meniscus in a non-retracted state of a fluid dispensing apparatus according to an embodiment of the present general inventive concept.

FIGS. 4 and 5 are partial cross-sectional views of another fluid ejector having a fluid reservoir with a back pressure regulator disposed therein of a fluid dispensing apparatus according to an embodiment of the present general inventive concept. The fluid ejector 48 is illustrated with the fluid meniscus 26 in the retracted state (FIG. 4) and the fluid meniscus 26 in the non-retracted state (FIG. 5). Referring to FIGS. 4 and 5, the fluid reservoir 25 is configured to supply the fluid to the ejection chamber 22 through the fluid channel 27 disposed upstream of the ejection chamber 22. In one embodiment, the fluid reservoir 25 may also serve as a fluid supply and also include the back pressure regulator 14 integrated therein. For example, the back pressure regulator 14 in the fluid reservoir 25 may include an inflatable bag (not illustrated) connected to the pressure reference port 14*a* with the fluid disposed outside of the inflatable bag. In this embodiment, the pressure received by the pressure reference port 14*a* allows the inflatable bag to inflate and deflate to pressurize the fluid on the outside of the inflatable bag and within the fluid reservoir 15, in other embodiments, the back pressure regulator 14, for example, in the fluid ejector 48 may be foam or any other back pressure regulator known to one of ordinary skill in the art.

In one embodiment, the leaking member 11*a* may include a port configured to allow air to pass therethrough. The size of the port may correspond to a desired amount of air to let leak therethrough, for example, for a given vacuum pump 12 the leak may be 10% of the total flow capability. The leaking member 11*a* may also include a conduit, hose, tube, channel, or the like. In one embodiment, the leaking member 11*a* changes (e.g., reduces) the negative pressure to substantially the atmospheric pressure in response to deactivation of the vacuum pump 12, and provides the reduced negative pressure to the pressure reference port 14*a* of the back pressure regulator 14 to move the fluid meniscus 26 from the fluid channel 27 (FIGS. 2 and 4) to downstream of the fluid channel 27 (FIGS. 3 and 5).

In one embodiment, the fluid dispensing apparatus 100 also includes a control unit 10 having a memory 10*a* configured to selectively activate the vacuum pump 12 based on at least one of an activation event and a predetermined activation time period and to selectively deactivate the vacuum pump 12 mode based on at least one of a deactivation event and a predetermined deactivation time period. The instructions and/or code may be stored in the memory 10*a* of the control unit 10. In one embodiment, the predetermined activation time period may be in a range of, but not limited to, 10 ms to 500 ms and the predetermined deactivation time period may be in a range of, but not limited to, 10 ms to 500 ms.

In other embodiments, an activation event for the control unit 10 to activate the vacuum pump 12 may be activated during a pen servicing event and deactivation events for the control unit 10 to deactivate the vacuum pump 12 may be deactivated during a printing event. The control unit 10 may be implemented in hardware, software, or in a combination of hardware and software. In other embodiments, the control unit 10 may be implemented in whole or in part as a computer program stored in the fluid dispensing apparatus 100 locally or remotely in a printer server or a host computing device to be considered part of the fluid dispensing apparatus 100.

Figure 6:
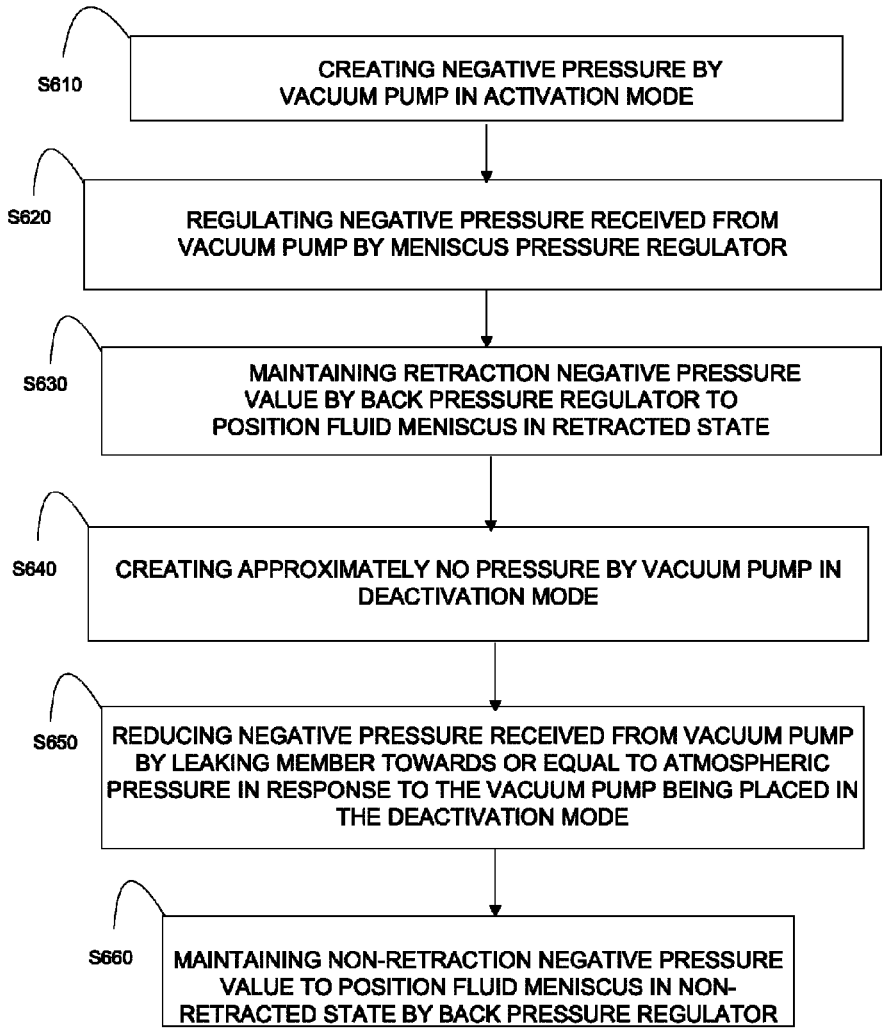
FIG. 6 is a flowchart illustrating a fluid dispensing method according to an embodiment of the present general inventive concept.

FIG. 6 is a flowchart illustrating a fluid dispensing method according to an embodiment of the present general inventive concept. Referring to FIG. 6, in operation S610, a negative pressure is created by a vacuum pump in an activation mode. In operation S620, the negative pressure received from the vacuum pump is regulated by a meniscus pressure regulator. In operation S630, a retraction negative pressure value is maintained by a back pressure regulator to position a fluid meniscus in a retracted state. In operation S640, the vacuum pump creates approximately no pressure in a deactivation mode. In operation S650, the negative pressure received from the vacuum pump is reduced by a leaking member towards or equal to atmospheric pressure in response to the vacuum pump being placed in the deactivation mode. In operation S660, a non-retraction negative pressure value to position the fluid meniscus in a non-retracted state is maintained by the back pressure regulator.

In the present embodiment, the retraction negative value is a predetermined pressure value produced by the back pressure regulator added to the regulated negative pressure received at a pressure reference port of the back pressure regulator. Also, the non-retraction negative pressure value is the predetermined pressure value added to the reduced negative pressure received at the pressure reference port of the back pressure regulator which in the non-retracted state is approximately zero. In one embodiment, the vacuum pump is activated by a control unit based on at least one of an activation event and a predetermined activation period of time. The vacuum pump is deactivated by the control unit, for example, based on at least one of a deactivation event and a predetermined deactivation period of time.

It is to be understood that the flowchart of FIG. 6 illustrates an architecture, functionality, and operation of exemplary embodiments of the present general inventive concept. If embodied in software, each block may represent a module, segment, or portion of code that comprises one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be scrambled relative to the order illustrated. Also, two or more blocks illustrated in succession in FIG. 6 may be executed concurrently or with partial concurrence. All such variations are within the scope of the present general inventive concept.

Also, the present general inventive concept can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other embodiments, the present general inventive concept can be implemented in a combination of software and data executed and stored under the control of a computing device.

Once given the above disclosure, many other features, modifications or improvements will become apparent to the skilled artisan. Such features, modifications or improvements are, therefore, considered to be a part of the general inventive concept, the scope of which is to be determined by the following claims.

What is claimed is:

1. A fluid dispensing apparatus, comprising:

a fluid ejector including a nozzle, an ejection chamber in communication with the nozzle, a fluid channel in communication with the ejection chamber, and a fluid reservoir having fluid in communication with the fluid channel;

a vacuum pump configured to create negative pressure in an activation mode and to create approximately no pressure in a deactivation mode;

a meniscus pressure regulator configured to regulate the negative pressure received from the vacuum pump;

a leaking member configured to reduce the negative pressure received from the vacuum pump towards or equal to atmospheric pressure in response to the vacuum pump being placed in the deactivation mode; and a back pressure regulator having a pressure reference port to receive the reduced negative pressure from the leaking member and the regulated negative pressure from the meniscus pressure regulator, the back pressure regulator configured to maintain a non-retraction negative pressure value to position a fluid meniscus in a non-retracted state and a retraction negative pressure value to position the fluid meniscus in a retracted state, wherein the non-retracted state comprises the fluid meniscus disposed in at least one of the nozzle and the ejection chamber downstream of the fluid channel, and the retracted state comprises the fluid meniscus disposed in the fluid channel disposed upstream from the ejection chamber.

2. The apparatus according to claim 1, wherein:

the non-retraction negative pressure value is a predetermined pressure value produced by the back pressure regulator added to the reduced negative pressure received at the pressure reference port; and the refraction negative pressure value is the predetermined pressure value added to the regulated negative pressure received at the pressure reference port.

3. The apparatus according to claim 2, wherein:

the predetermined pressure value is approximately −6 inches of water pressure;

the regulated negative pressure is in a range of approximately −24 inches of water pressure to −37 inches of water pressure;

the retraction negative pressure value is in a range from −30 inches of water pressure to −43 inches of water pressure;

the reduced negative pressure is in a range from approximately atmospheric pressure to −9 inches of water pressure; and the non-retraction negative pressure value is in a range from approximately −6 inches of water pressure to −15 inches of water pressure.

4. The apparatus according to claim 1, wherein the meniscus pressure regulator comprises:

a predetermined regulator set point in a range of −24 inches of water pressure to −37 inches of water pressure.

5. The apparatus according to claim 1, wherein:

the ejection chamber having an ejection member configured to apply an ejection pressure to the fluid to eject the fluid through the nozzle; and the fluid reservoir configured to supply the fluid to the ejection chamber through the fluid channel disposed between the fluid reservoir and the ejection chamber.

6. The apparatus according to claim 1, wherein:

the back pressure regulator positioned upstream from the fluid channel and configured to draw the fluid meniscus into the fluid channel to position the fluid meniscus in the retracted state.

7. The apparatus according to claim 1, further comprising:

a control unit configured to selectively place the vacuum pump in the activation mode based on at least one of an activation event and a predetermined activation time period and the deactivation mode based on at least one of a deactivation event and a predetermined deactivation time period.

8. The apparatus according to claim 1, wherein the leaking member comprises:

a port configured to allow air to pass therethrough.

9. The apparatus according to claim 1, further comprising:

a fluid supply configured to supply the fluid to the fluid reservoir of the fluid ejector through the back pressure regulator, wherein the fluid supply is a removable off-axis ink cartridge.

10. The apparatus according to claim 1, wherein the back pressure regulator is integrated into the fluid reservoir of the fluid ejector.

11. The apparatus according to claim 1, wherein:

the fluid dispensing apparatus comprises an inkjet printing apparatus;

the fluid comprises ink; and the fluid ejector comprises a removable inkjet print head.

12. A fluid dispensing method, comprising:

creating a negative pressure by a vacuum pump in an activation mode;

regulating the negative pressure received from the vacuum pump by a meniscus pressure regulator;

maintaining a retraction negative pressure value by a back pressure regulator to position a fluid meniscus in a retracted state in a fluid channel upstream from an ejection chamber;

creating approximately no pressure by the vacuum pump in a deactivation mode;

reducing the negative pressure received from the vacuum pump by a leaking member towards or equal to atmospheric pressure in response to the vacuum pump being placed in the deactivation mode; and maintaining a non-retraction negative pressure value by the back pressure regulator to position the fluid meniscus in a non-retracted state in at least one of the ejection chamber downstream of the fluid channel and a nozzle downstream of the ejection chamber.

13. The method according to claim 12, wherein:

the retraction negative value is a predetermined pressure value produced by the back pressure regulator added to the regulated negative pressure received at a pressure reference port of the back pressure regulator; and the non-retraction negative pressure value is the predetermined pressure value added to the reduced negative pressure received at the pressure reference port of the back pressure regulator.

14. The method according to claim 12, wherein:

the vacuum pump is placed in the activation mode by a control unit based on at least one of an activation event and a predetermined activation period of time; and the vacuum pump is placed in the deactivated mode by the control unit based on at least one of a deactivation event and a predetermined deactivation period of time.

15. An inkjet printing apparatus, comprising:

a fluid ejector including a nozzle, an ejection chamber in communication with the nozzle, a fluid channel in communication with the ejection chamber, and a fluid reservoir having fluid in communication with the fluid channel;

a vacuum pump configured to create negative pressure in an activation mode and to create approximately no pressure in a deactivation mode;

a meniscus pressure regulator configured to regulate the negative pressure received from the vacuum pump;

a leaking member configured to reduce the negative pressure received from the vacuum pump towards or equal to atmospheric pressure in response to the vacuum pump being placed in the deactivation mode; and a back pressure regulator having a pressure reference port to receive the reduced negative pressure from the leaking member and the regulated negative pressure from the meniscus pressure regulator, the back pressure regulator configured to maintain a non-retraction negative pressure value to position a fluid meniscus in a non-retracted state and a retraction negative pressure value to position the fluid meniscus in a retracted state, the back pressure regulator positioned upstream from the fluid channel and configured to draw the fluid meniscus into the fluid channel to position the fluid meniscus in the retracted state;

wherein the non-retraction negative pressure value is a predetermined pressure value produced by the back pressure regulator added to the reduced negative pressure received at the pressure reference port, and the retraction negative pressure value is the predetermined pressure value added to the regulated negative pressure received at the pressure reference port.

16. The apparatus according to claim 15, wherein the non-retracted state comprises the fluid meniscus disposed in at least one of the nozzle and the ejection chamber downstream of the fluid channel, and the retracted state comprises the fluid meniscus disposed in the fluid channel disposed upstream from the ejection chamber.

17. The apparatus according to claim 15, wherein the activation mode comprises a servicing event and the deactivation mode comprises a printing event.

18. The apparatus according to claim 1, wherein the fluid dispensing apparatus comprises an inkjet printing apparatus, and wherein the activation mode comprises a servicing event and the deactivation mode comprises a printing event.

19. The method according to claim 12, wherein maintaining the retraction negative pressure value by the back pressure regulator includes drawing the fluid meniscus into the fluid channel to position the fluid meniscus in the retracted state.

* * * * *